US006964177B2

(12) United States Patent
Lee et al.

(10) Patent No.: US 6,964,177 B2
(45) Date of Patent: Nov. 15, 2005

(54) REFRIGERATOR WITH ICEMAKER

(75) Inventors: Myung Ryul Lee, Sungnam-si (KR); Wook Yong Lee, Gwangmyeong-si (KR); Eui Yeop Chung, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/752,009

(22) Filed: Jan. 7, 2004

(65) Prior Publication Data

US 2004/0237565 A1 Dec. 2, 2004

(30) Foreign Application Priority Data

May 28, 2003 (KR) ..... 10-2003-0034084
May 28, 2003 (KR) ..... 10-2003-0034083

(51) Int. Cl.[7] ..... F25C 1/12
(52) U.S. Cl. ..... 62/320; 62/441; 62/353
(58) Field of Search ..... 62/340–356, 441–447

(56) References Cited

U.S. PATENT DOCUMENTS 5,272,888 A * 12/1993 Fisher et al. ..... 62/344
5,375,432 A * 12/1994 Cur ..... 62/320
5,758,512 A 6/1998 Peterson et al.
6,050,097 A 4/2000 Nelson et al.
6,082,130 A 7/2000 Pastryk et al.
6,148,624 A 11/2000 Bishop et al.
6,286,324 B1 9/2001 Pastryk et al.
6,314,745 B1 11/2001 Janke et al.
6,351,958 B1 3/2002 Pastryk et al.
6,474,094 B2 * 11/2002 Kim ..... 62/441

FOREIGN PATENT DOCUMENTS

JP 06-011228 1/1994
KR 2000-0001864 1/2000

* cited by examiner

*Primary Examiner*—William E. Tapolcai
(74) *Attorney, Agent, or Firm*—Birch, Stewart, Kolasch & Birch, LLP

(57) ABSTRACT

Disclosed is a refrigerator with an improved structure for supplying ices at an outside of a dispenser provided at a door. The refrigerator includes a supplementary freezer, a cavity, an icemaker and a dispenser. The supplementary freezer is provided in a cooling chamber of the refrigerator. The cavity is provided in the door and is connected with the supplementary freezer when the door is closed. The icemaker produces ices using cool air in the cooling chamber. The dispenser is connected with the cavity provided at the door. In this case, the icemaker is provided in the supplementary freezer or in the cavity.

21 Claims, 10 Drawing Sheets

REFRIGERATOR WITH ICEMAKER

CROSS-REFERENCE TO RELATED APPLICATIONS

This application claims the benefit of Korean Application Nos. P2003-34083, P2003-34084 filed on May 28, 2003, which is hereby incorporated by reference as if fully set forth herein.

BACKGROUND OF THE INVENTION

1. Field of the Invention

The present invention relates to a refrigerator, and more particularly, to a refrigerator having an icemaker for supplying ice through a dispenser provided at a door.

2. Discussion of the Related Art

A refrigerator is an apparatus for taking storage of foods freshly for a long-term period. Such refrigerator has a food-storage chamber therein. The food-storage chamber is always maintained at a low temperature by a refrigerating cycle for keeping food fresh.

The food-storage chamber is divided into a plurality of storage chambers having different characteristics such that a user can choose a food-storage method in consideration of a kind, a characteristic and an expiration date of food. Typical examples of the storage chambers are a cooling chamber and a freezer.

The cooling chamber keeps a temperature approximately at 3° C.–4° C. for keeping food and vegetables fresh for a long time. The freezer keeps a temperature at a sub-zero temperature for keeping and storing meat and fish frozen for a long time and making and storing ice.

Meanwhile, the refrigerator is developed for performing additional functions except a typical function thereof. For example, a user had to open a door and take out a water bottle kept in the cooling chamber to drink cold water kept in the cooling chamber hitherto.

However, a refrigerator having a water dispenser provided outside of the door for supplying cold water cooled by cool air of the cooling chamber is developed and the user can drink cold water at outside of the refrigerator without opening the door. Furthermore, a product with water purifying function being added to the water dispenser is being supplied.

Meanwhile, in a case of using ice when drinking and cooking, the user had to open the door of the freezer and take ice out of an ice tray being provided in the freezer.

However, in this case there is an inconvenience that the user has to open the door, take out the ice tray and separate ice from the ice tray. Also, when the door is open, cool air in the freezer leaks out and the temperature of the freezer goes up. Therefore, there is a problem that a compressor works more and thus, energy is wasted.

SUMMARY OF THE INVENTION

Accordingly, the present invention is directed to a refrigerator with an icemaker that substantially obviates one or more problems due to limitations and disadvantages of the related art.

An object of the present invention is to provide a refrigerator with an icemaker, the refrigerator having an improved structure in which ices are supplied at an outside of the refrigerator without opening a door.

Another object of the present invention is to provide a refrigerator with an icemaker in a structure wherein a dispenser is provided at a convenient location for the user to use.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, the refrigerator with the icemaker includes a supplementary freezer, a cavity, an icemaker and a dispenser. The dispenser is communicated with the cavity at the door. In this case, the icemaker is provided in the supplementary freezer or at the cavity. The supplementary freezer provided at an upper part of the cooling chamber includes a housing having an outlet communicated with the cavity when the door is closed, and an evaporator provided in the housing. Also, it is desirable that the cavity is surrounded with the insulating material.

In another aspect of the present invention, a refrigerator with an icemaker further includes a shutter provided between the cavity and the dispenser for selectively supplying ices to the dispenser. The refrigerator further includes an ice container provided at the cavity for storing ices produced from the icemaker. In this case, the ice container includes an opened top for receiving the ices produced and dropped from the icemaker and an outlet provided at a lower part thereof for discharging the ices to the dispenser.

Yet, in another aspect of the present invention, a refrigerator with an icemaker further includes a transferring device provided in the door or the ice container for transferring ices stored in the cavity or the ice container to the outlet being communicated with the dispenser. In this case, the transferring device includes an auger rotatably provided in the door or the cavity for transferring ices to the outlet and a motor being coupled with the shaft of the auger.

Yet, in another aspect of the present invention, a refrigerator with an icemaker further includes a crusher provided in the cavity or the ice tray for crushing ices stored in the cavity. In this case, the crusher includes a shaft rotated by the motor and at least one blades extended from the shaft and rotating with the shaft for crushing ices.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
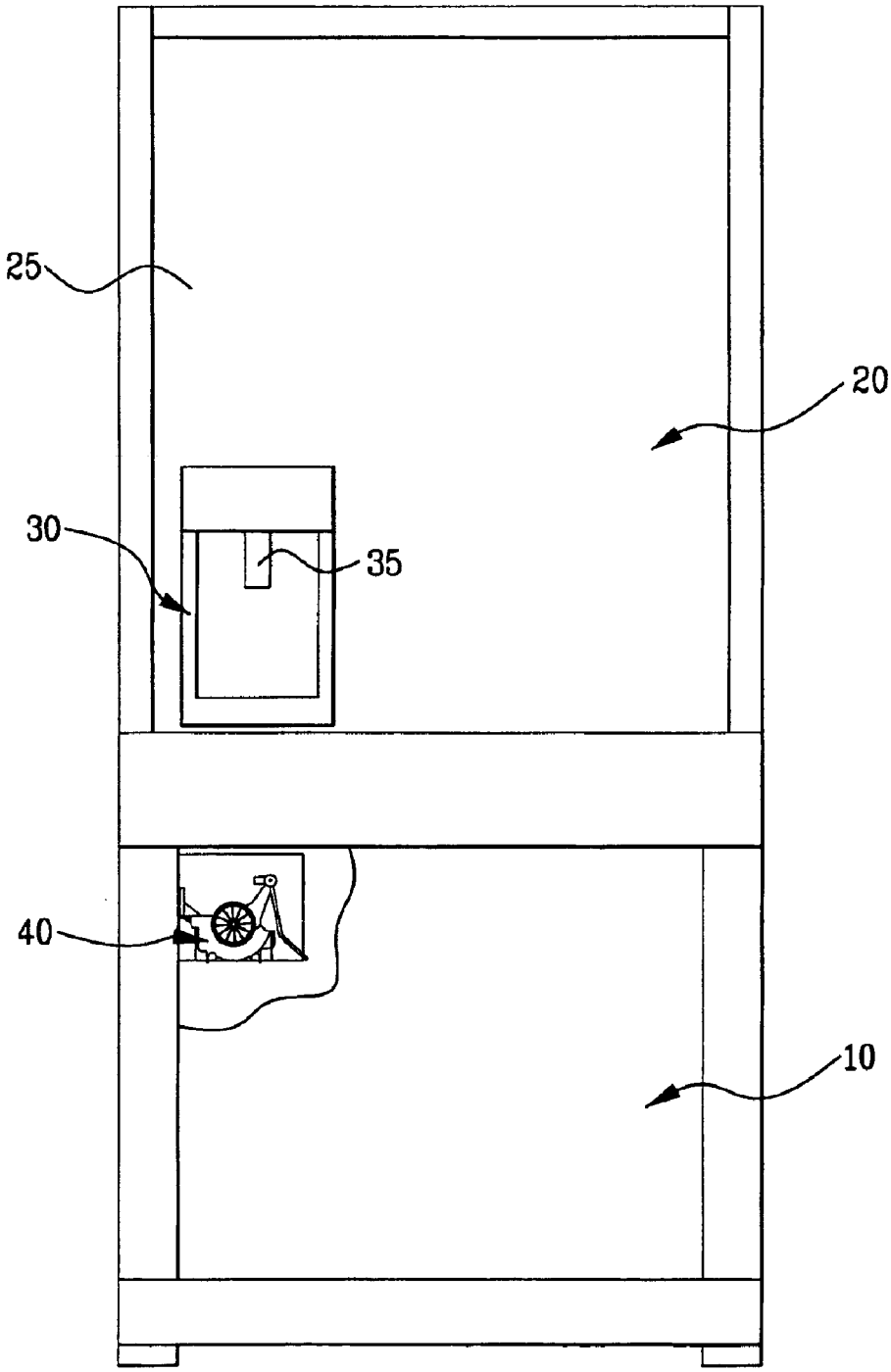
FIG. 1 illustrates a front cutaway view of a refrigerator according to a first embodiment of the present invention.

A conventional refrigerator has a structure that a cooling camber and a freezer are provided at a lower part and an upper part of the refrigerator, respectively. However, as illustrated in FIG. 1, a refrigerator according to the present invention has a structure that a cooling chamber and a freezer are provided at the upper part and the lower part of the refrigerator, respectively. As a reference, FIG. 1 is a front view of a refrigerator, with a incised part, according to a first embodiment of the present invention and FIG. 2 is a sectional side view roughly showing an inside structure of the refrigerator of FIG. 1.

Hereinafter, a structure of a refrigerator according to a first embodiment of the present invention will be described with reference to above drawings.

Figure 2:
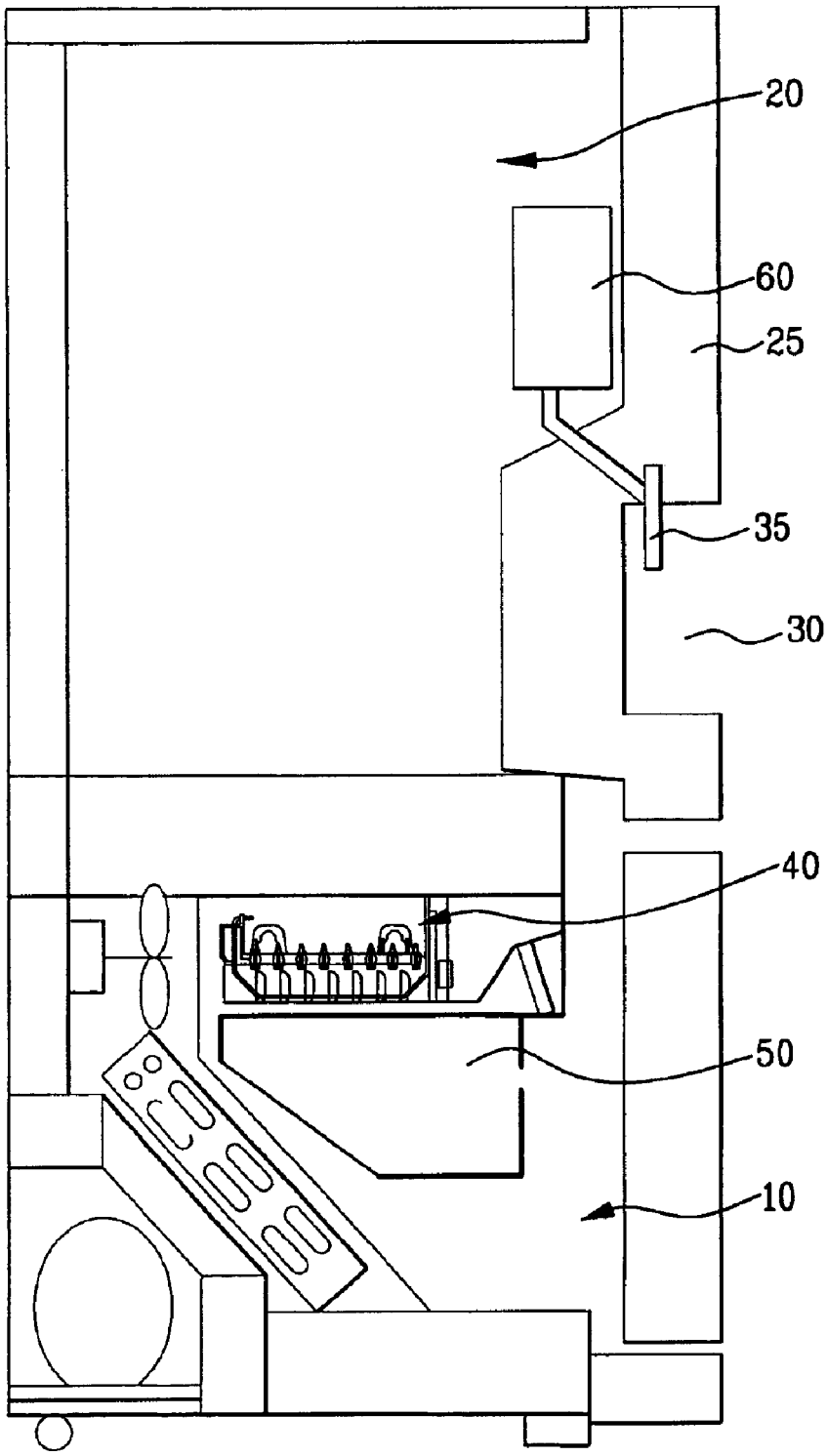
FIG. 2 illustrates a sectional side view roughly showing an inside structure of the refrigerator of FIG. 1.

As illustrated in FIG. 1 and FIG. 2, the refrigerator according to the first embodiment of the present invention includes a cooling chamber 20 provided at an upper part thereof and a freezer 10 provided at a lower part thereof. A door 25 is provided at a front side of the refrigerator and a dispenser 30 is provided at the door 25. The dispenser 30 directly supplies cold water to a user outside of the refrigerator without opening the door 25. For this, a water tank 60 is provided at an inside of the door 25 being in contact with the cooling chamber 20 as illustrated in FIG. 2. The water tank 60 stores water and cool air in the cooling chamber 20 cools water stored in the water tank 60. Accordingly, the user is supplied with cold water stored in the water tank 60 through the dispenser 30 when the user operates a lever 35.

As aforementioned, the refrigerator according to the first embodiment of the present invention has a structure that the cooling chamber 20 is provided at the upper part thereof and the freezer is provide at the lower part thereof such that the user is supplied with cold water through the dispenser 30 at a convenient location. If the cooling chamber is provided at the lower part of the refrigerator as a conventional refrigerator, the dispenser for supplying cold water is also provided at the lower part of the refrigerator. The user can not use the dispenser easily and conveniently if the refrigerator has the structure.

Meanwhile, the refrigerator according to the first embodiment of the present invention includes not only the dispenser 30 for supplying cold water but also an icemaker 40 for producing and supplying a great deal of ice pieces. Hereinafter, the icemaker 40 will be described in detail with reference to drawings. As a reference, FIG. 3 illustrates a perspective view showing an ice-supplying system at a refrigerator of FIG. 1 and FIG. 4 illustrates a side sectional view showing an ice-supplying system of FIG. 3.

Referring to FIG. 1 and FIG. 2, the ice-supplying system is provided in the freezer 10 being provided at the lower part of the refrigerator. The ice-supplying system includes an icemaker 40 for producing ice using cool air of the freezer 10 and an ice container 50 for storing ice produced from the icemaker 40 as illustrated in FIG. 2 and FIG. 4.

Figure 3:
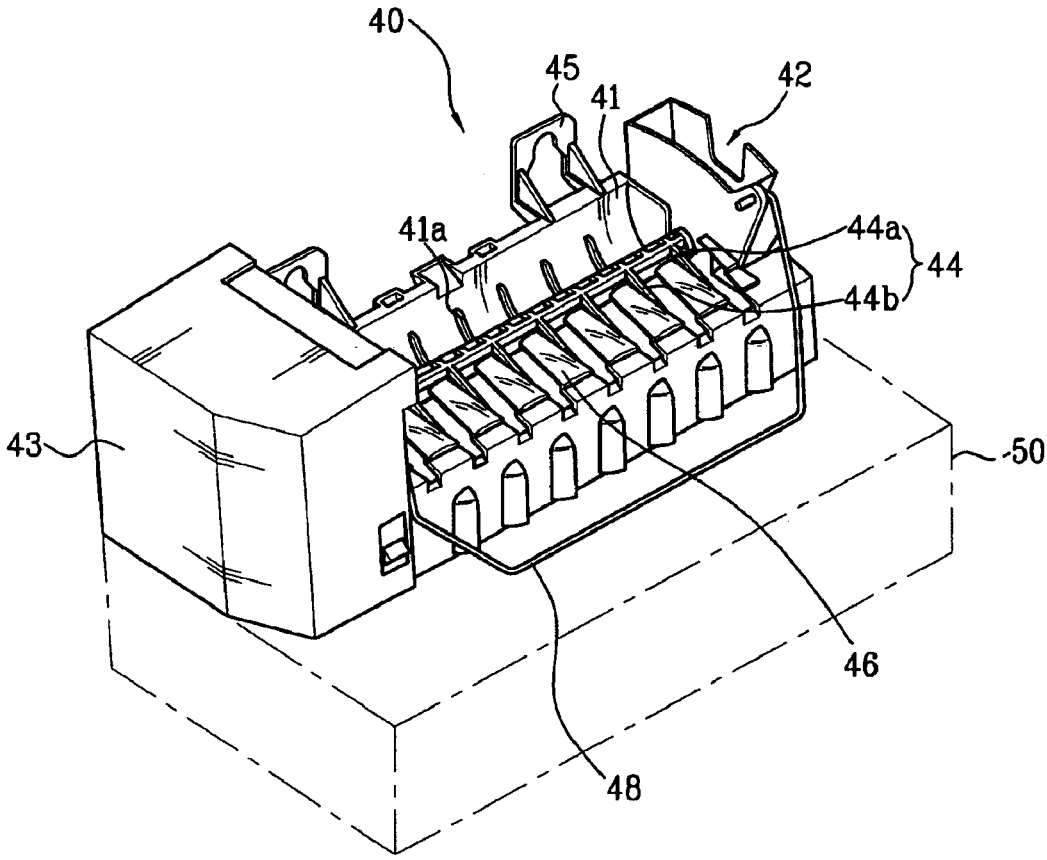
FIG. 3 illustrates a perspective view showing an ice-supplying system at a refrigerator of FIG. 1.
Figure 4:
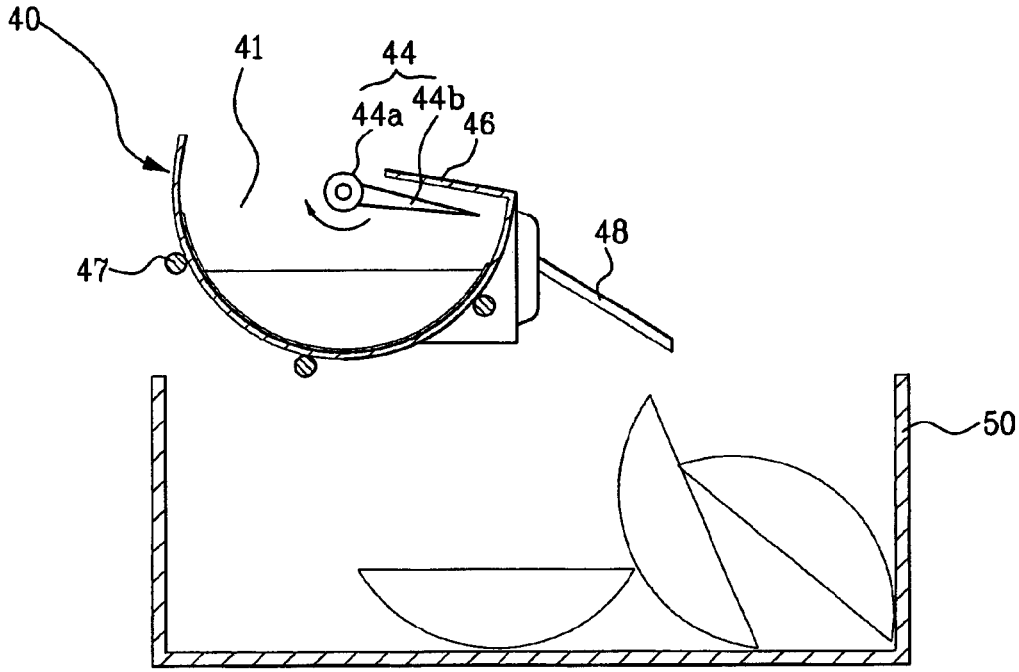
FIG. 4 illustrates a sectional side view showing an ice-supplying system of FIG. 3.

As illustrated in FIG. 3 and FIG. 4, the icemaker 40 includes an ice tray 41, a water supplier 42, an ejector 44 and a motor 43. In this case, the ice tray 41 being in a semi-cylindrical form has an opened upper part for storing water and ice therein as illustrated in FIG. 3 and FIG. 4. A plurality of ribs 41*a* dividing the inner space of the ice tray 41 into a plurality of spaces are provided in the ice tray 41. The ribs 41*a* are projected in a radius direction as illustrated in FIG. 3 in order that the ice tray 41 can produce a plurality of little pieces of ice.

The water supplier 42 is provided at a side of the ice tray 41 as illustrated in FIG. 3 and takes a role of supplying water to the ice tray 41. At a rear of the ice tray 41, a bracket 45 is provided for fixing the icemaker 40 to the freezer 10.

Meanwhile, the ejector 44 includes a shaft 44*a* and a plurality of fins 44*b*. The shaft 44*a* is arranged to cross the center of the ice tray 41 along the longitudinal direction at the upper part of the ice tray 41. It is desirable that the fins 44*b* are formed at an interval along the longitudinal direction of the shaft 44*a*. Particularly, the fins 44*b* are arranged at each space in the ice tray 41 by each of the ribs 41*a*.

The motor 43 is provided at an outer circumference of the ice tray 41 to be coupled with the shaft 44*a* as illustrated in FIG. 3. Accordingly, when the shaft 44*a* rotates by the motor 43, the fins 44*b* rotate together with the shaft 44*a*. The fins 44*b* push ices in the ice tray 41 and drop ices to a lower part of the icemaker 40.

Referring to FIG. 3 and FIG. 4, a plurality of strips 46 are provided at an upper end of a front side of the ice tray 41, i.e., an opposite side of the bracket 45. Each of the stripes 46 is extended from the front side of the ice tray 41 to near the shaft 44*a*. There exist little gaps between each of the stripes 46 and the fins 44*b* passes through the fins 44*b* when the shaft 44*a* rotates.

Meanwhile, ices in the ice tray 41 are pushed by the fins 44*b*, separated from the ice tray 41, and dropped to the stripes 46 when the shaft 44*a* rotates. Ices dropped to the stripes 46 are dropped to and stored in the ice container 50 provided at a lower part of the icemaker 40. Accordingly, an upper surface of the stripes 46 leads to drop ices being separated from the ice tray 41 to a lower part. Therefore, it is desirable that the stripes 46 are inclined to a side and thus a part of the stripes 46 near the shaft 44*a* is arranged at a higher place than the front side of the ice tray 41.

A structure is needed for preventing ices separated from the ice tray 41 from being dropped to a rear side of the ice tray 41. For this, it is desirable that a rear end of the ice tray 41 is provided to be higher than the shaft 44*a* as illustrated in FIG. 4 according to the present invention. Then, ices being separated from the ice tray 41 are moved to a rear side of the ice tray 41 by the fins 44*b*, are smoothly leaded to the front side of the ice tray 41 and are dropped to the upper surface of the stripes 46.

Meanwhile, a heater 47 is provided at a lower surface of the ice tray 41 as illustrated in FIG. 4. The heater 47 heats a surface of the ice tray 41 for a short time and melts ices on the surface of the ice tray 41. Accordingly, ices are easy to be separated when the shaft 44*a* and the fins rotate.

Referring to FIG. 3 and FIG. 4, a sensing arm is provided in the icemaker 40 for estimating an amount of ices stored in the ice container 50. The sensing arm 48 estimates the amount of ices stored in the ice container 50 by being controlled by a controller (not illustrated) and moving up and down. For example, the sensing arm 48 periodically descended. Descending amount is large when a small amount of ices are stored in the ice container 50. On the other hand, the sensing arm 48 is bumped into ices and thus descending amount is small when a large amount of ices are stored in the ice container 50. Accordingly, the controller estimates the amount of ices in the ice container 50 with a descended amount.

The ice container 50 having an opened upper part is provided at a lower part of the icemaker 40 as illustrated in FIG. 4. Accordingly, ices produced from the icemaker 40 and dropped to the lower part thereof and stored in the ice container 50.

A user can be supplied with ices stored on the ice container 50 at any time when the ice-supplying system is provided in the freezer 10. However, in a case of the refrigerator having the above structure according to the first embodiment of the present invention, ices are not supplied through the dispenser 30 being provided at the door 25. In other words, it is inconvenient that the user can be supplied with only cold water through the dispenser 30 in a case of the refrigerator according to the first embodiment of the present invention. Therefore, it is required to change the structure in order that the user can be supplied with ices through the dispenser at a convenient location to use.

The present invention provides a refrigerator with an improved structure to solve the problem of the first embodiment. In a case of the refrigerator according to second and third embodiments of the present invention, the user can be supplied with ices through the dispenser being located at a convenient location to use, i.e., about an upper part of the refrigerator. Of course, if necessary, not only ices but also cold water can be selectively supplied through the dispenser.

The second and third embodiment include a supplementary freezer 300 provided in a cooling chamber 200 of the refrigerator, an icemaker 400 for producing ices using cool air of the supplementary freezer 300, a cavity 500 provided in a door 250 of the refrigerator and a dispenser 260 provided at an outside of the door 250 of the refrigerator. Hereinafter, a structure of a refrigerator according to the second and third embodiments of the present invention will be described with reference to drawings.

Figure 5:
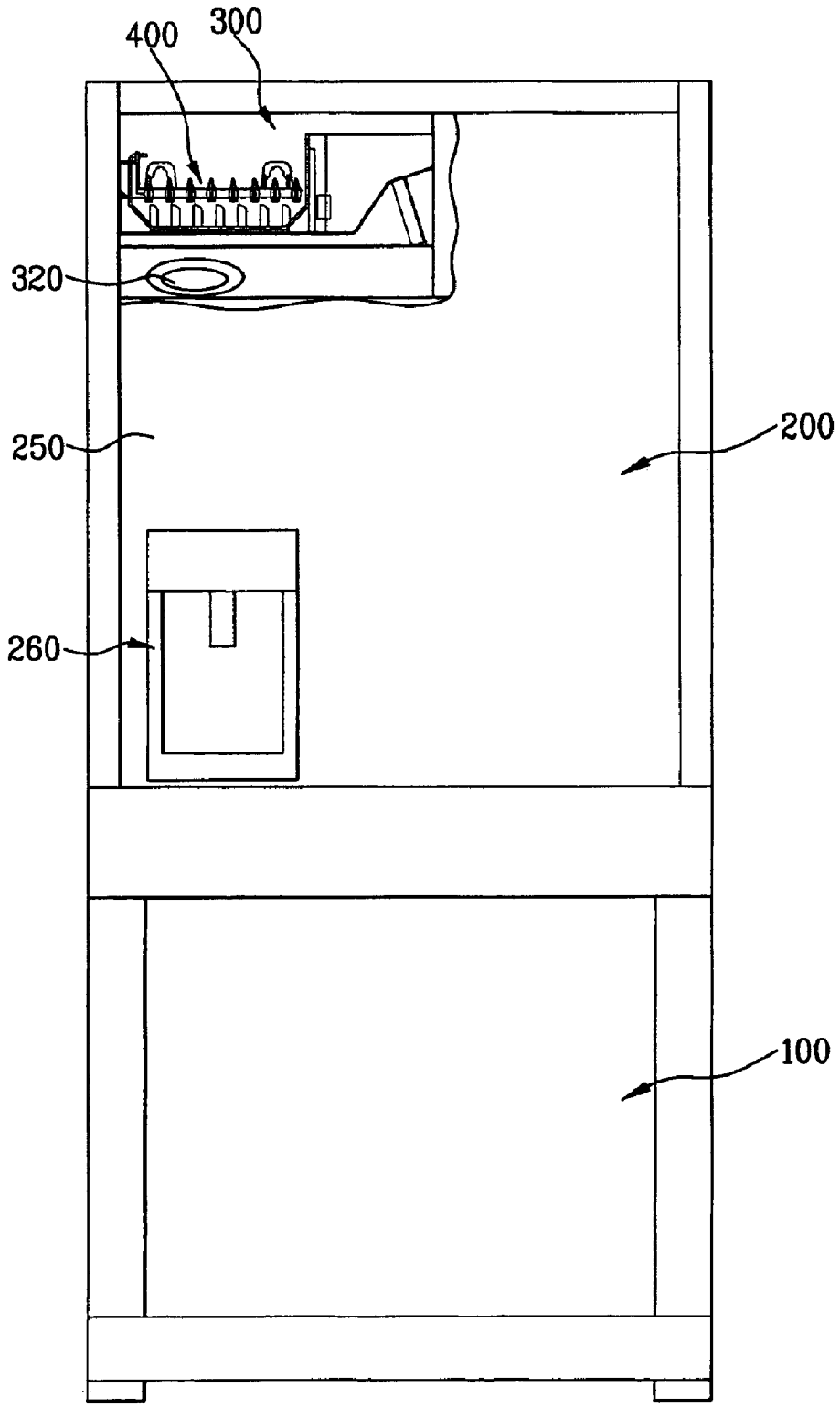
FIG. 5 illustrates a front cutaway view of a refrigerator according to a second embodiment of the present invention.
Figure 6A:
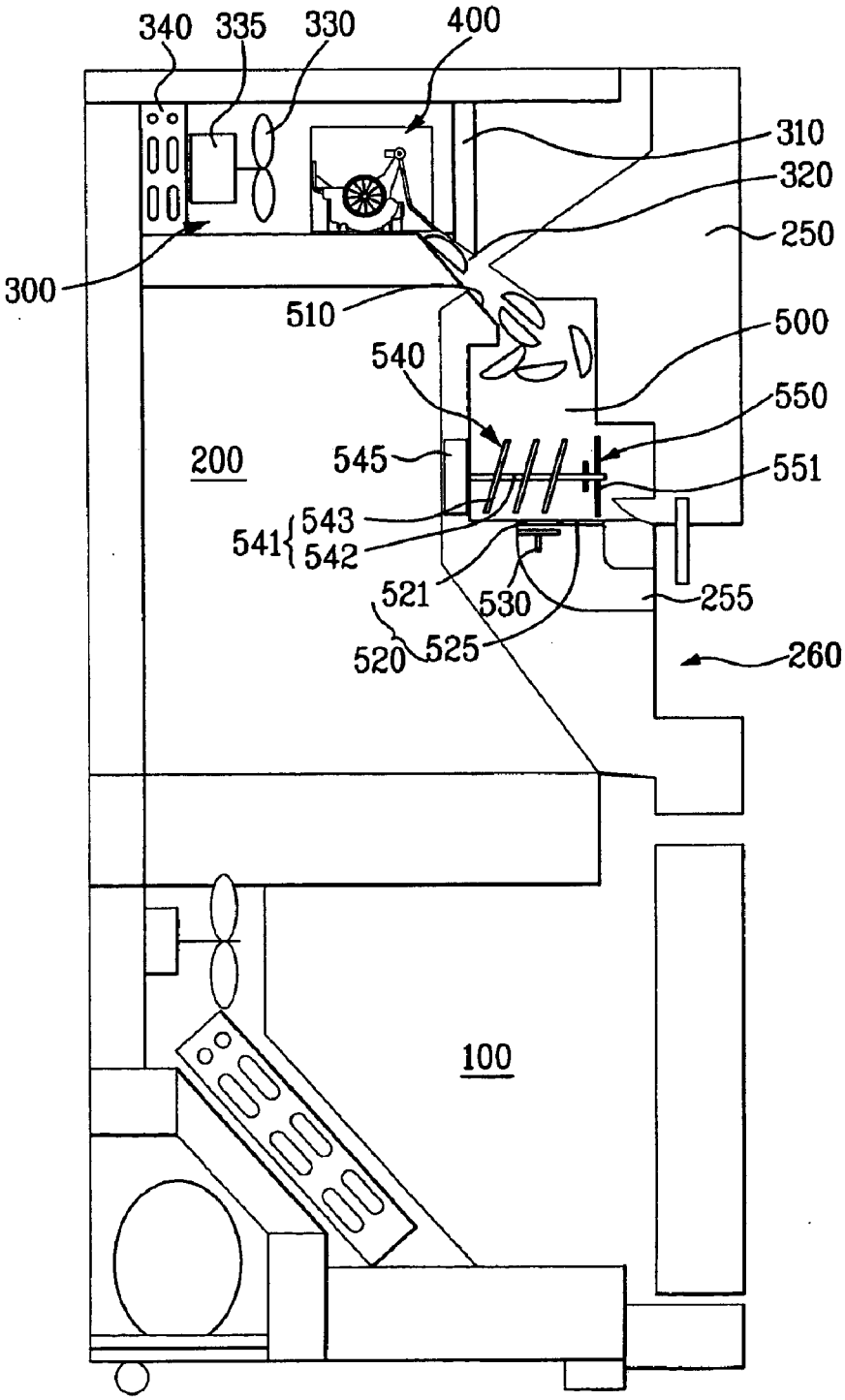
FIG. 6A illustrates a side sectional view roughly showing an inside structure of the refrigerator of FIG. 5.
Figure 6B:
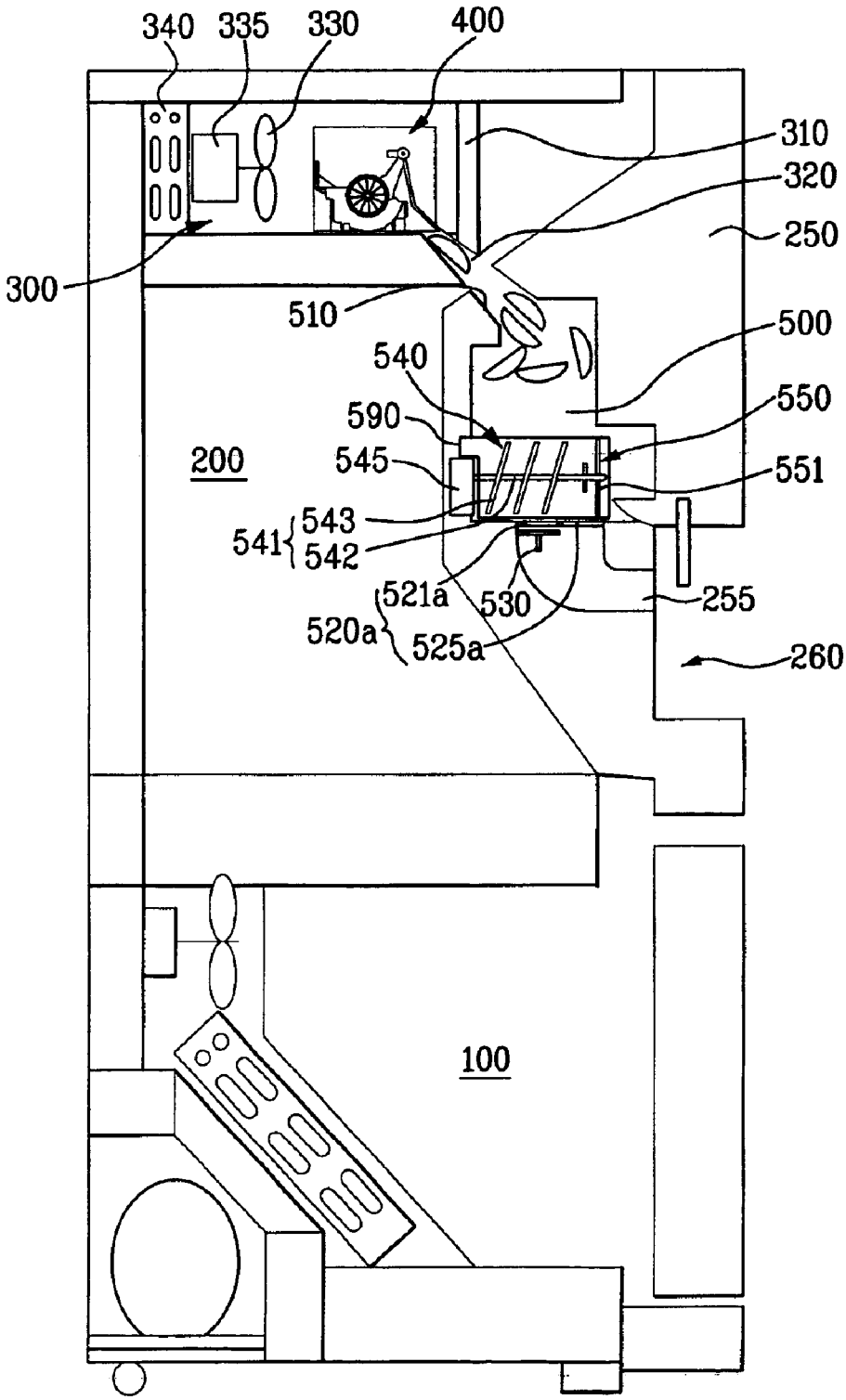
FIG. 6B illustrates a side sectional view showing a modified embodiment of the refrigerator of FIG. 6A.
Figure 7A:
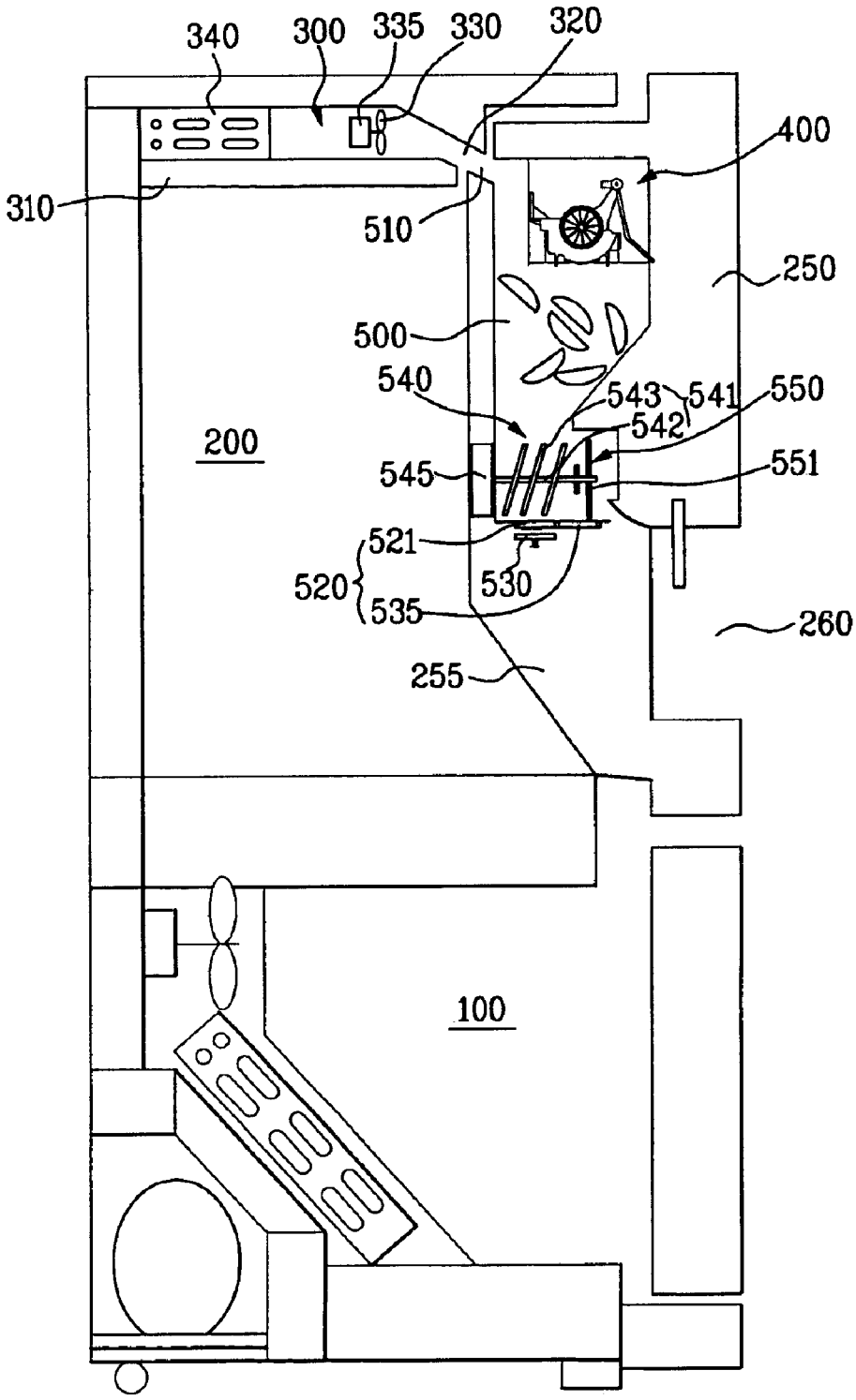
FIG. 7A illustrates a side sectional view showing a refrigerator according to a third embodiment of the present invention.
Figure 7B:
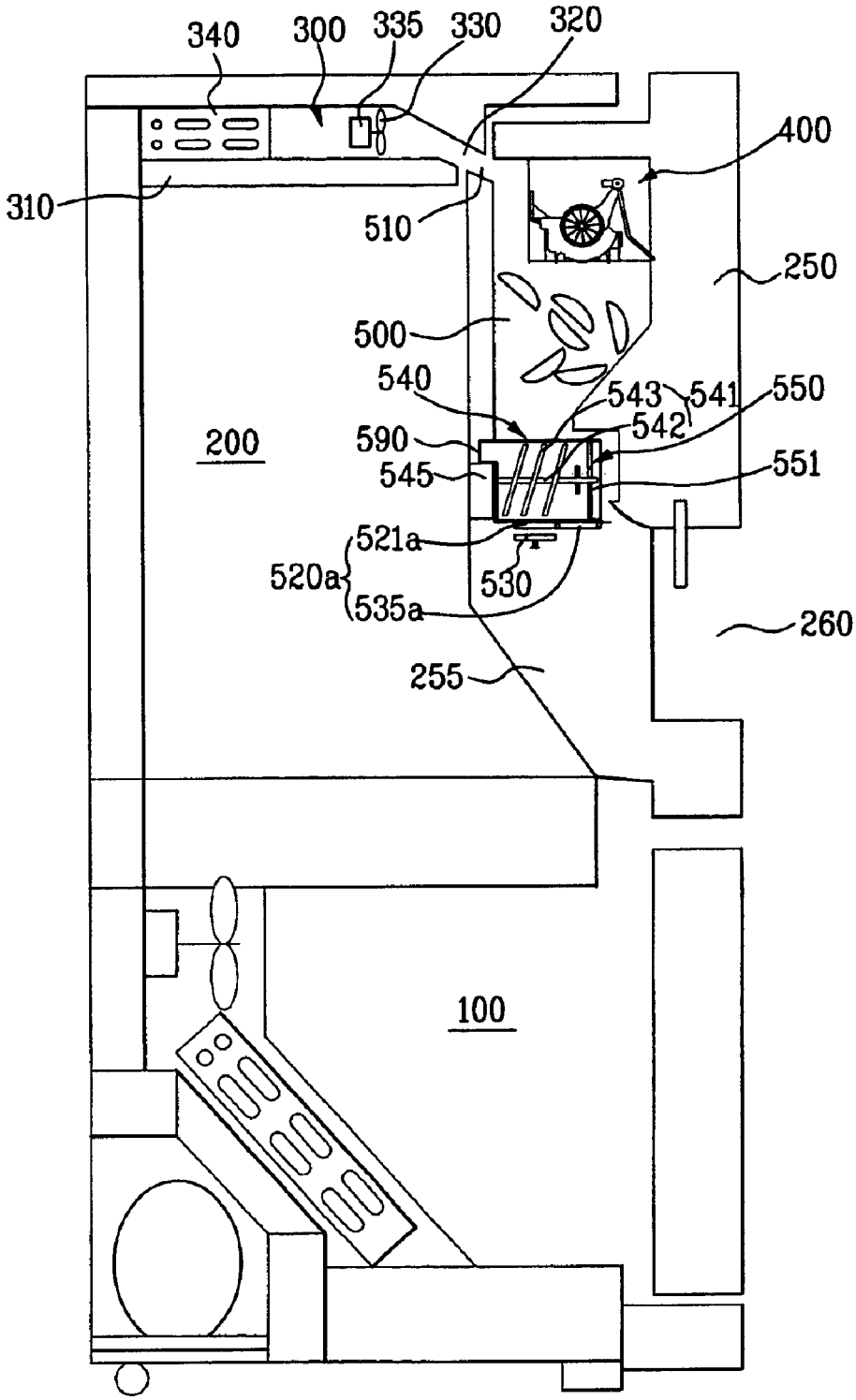
FIG. 7B illustrates a side sectional view showing a modified embodiment of the refrigerator of FIG. 7A.
Figure 8:
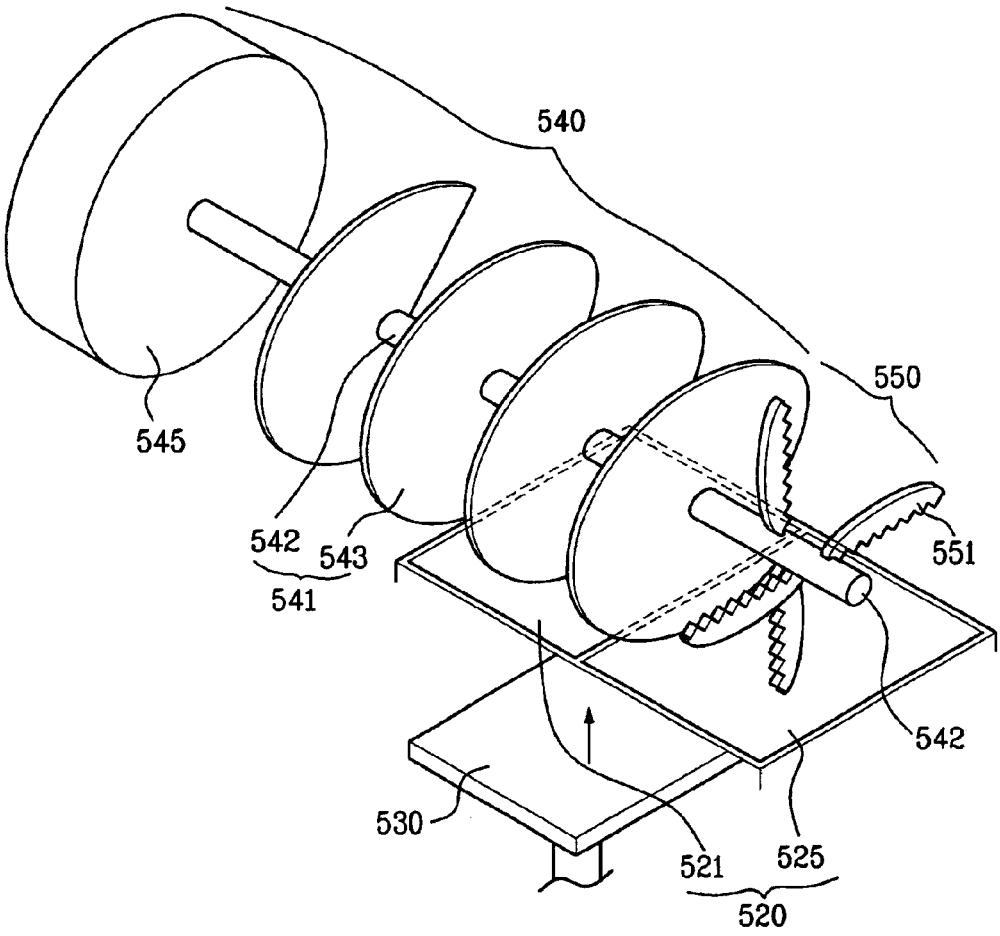
FIG. 8 illustrates a perspective view briefly showing a transferring device and a crusher in the refrigerator of FIG. 5.

As a reference, FIG. 5 illustrates a front cutaway view of a refrigerator according to a second embodiment of the present invention. FIG. 6A illustrates a sectional side view roughly showing an inside structure of the refrigerator of FIG. 5. FIG. 6B illustrates a side sectional view showing a modified embodiment of the refrigerator of FIG. 6A. FIG. 7A illustrates a side sectional view showing a refrigerator according to a third embodiment of the present invention. FIG. 7B illustrates a side sectional view showing a modified embodiment of the refrigerator of FIG. 7A. FIG. 8 illustrates a perspective view briefly showing a transferring device and a crusher in the refrigerator of FIG. 5. The refrigerator and structures of various embodiments according to the second and third embodiments of the present invention are very similar and therefore, they will be described together and the same reference numbers will be used throughout the drawings to refer to the same or like parts.

First, the refrigerator according to the second and third embodiments being different from the refrigerator according to the first embodiment further includes a supplementary freezer 300. The supplementary freezer 300 supplies cool air to the icemaker 400 and keeps ices frozen, ices being produced from the icemaker 400 and stored in the cavity 500. The supplementary freezer 300 is provided at an upper part of the refrigerator having the dispenser 260, i.e., in the cooling chamber 200. Meanwhile, the cooling chamber 200 in the second and third embodiments of the present invention is provided at an upper part in the refrigerator and the freezer 100 is provided at a lower part in the refrigerator as illustrated in FIG. 6 and FIG. 7.

The icemaker 400 produces ices using cool air of the supplementary freezer 300 and is provided at different locations in the second and third embodiments. Referring to FIG. 6A, in the case of the refrigerator according to the second embodiment of the present invention, the icemaker 400 is provided in the supplementary freezer 300 and the cavity 500 to which ices produced form the icemaker 400 is provided at the door 250. Referring to FIG. 7A, in the case of the refrigerator according to the third embodiment, the icemaker 400 is provided in the cavity 500 in the door 250. Meanwhile, a dispenser 260 is provided at the door 250 of the refrigerators according to the second and third embodiments.

The supplementary freezer 300 is, for example, provided at the upper part in the cooling chamber 200 as illustrated in FIG. 6A to FIG. 7B. The supplementary freezer 300 includes a housing 310, an outlet 320 and an evaporator 340. The housing 310 is provided in the cooling chamber 200 having a predetermined space therein independent, from the cooling chamber 200. The housing 310 includes an insulating material or is formed in a multi-layered structure with insulation layers.

The outlet 320 is provided to pass through a side of the housing 310, i.e., a front part of the housing 310. The outlet 320 allows the cavity 500 provided at the door 250 to communicate with the inner space of the housing 310 when the door 250 is closed as illustrated in FIG. 6A to FIG. 7B. Accordingly, cool air in the supplementary freezer 300 is transmitted to the cavity 500 through the outlet 320. Meanwhile, the outlet 320 plays a role of a passage transmitting ices to the cavity 500 in the second embodiment with a structure that the icemaker 400 is provided at the supplementary freezer 300.

The evaporator 340 is provided in the housing 310 and thus the supplementary freezer 300 is cooled apart from the cooling chamber 200. Meanwhile, the supplementary freezer 300 further includes a fan 330 for improving cooling function of the evaporator 340 in the supplementary freezer 300 as illustrated in FIG. 6A to FIG. 7B. When the fan 330 is further provided as above, heat exchange function is improved, the supplementary freezer 330 is more effectively cooled and cool air in the supplementary freezer 300 is well transmitted to the cavity 500 when the door 250 is closed. Meanwhile, the unexplained symbol 335 in FIG. 6A to FIG. 7B is the motor for rotating the fan 330.

The icemaker 400 in the second embodiment is provided in the supplementary freezer 300 as illustrated in FIG. 6A. When the icemaker 400 is provided in the supplementary freezer 300, cool air blown by the fan 330 is transmitted directly to the icemaker 400 and thus ices are produced in short time. A structure of the icemaker 400 is the same as that of the icemaker 40 being described with reference to FIG. 3 and FIG. 4 and more description of the icemaker 400 will be omitted.

The icemaker 400 is provided in the cavity 500 as illustrated in FIG. 7A in the third embodiment. When the icemaker 400 is provided as above, the supplementary freezer 300 may be manufactured to be smaller in size than that in the second embodiment, and thus, the size of the cooling chamber 200 may be manufactured to be large in size.

The cavity 500 provided in the door 250 is communicated with the supplementary freezer 300 when the door 250 is closed. For this, an inlet 510 is provided at the upper part of the cavity 500 as illustrated in FIG. 6A and FIG. 7A.

The inlet 510 is provided at a side of the cavity, i.e., the upper part of the cavity as illustrated in FIG. 6 to be connected with the outlet 320 of the supplementary freezer 330 when the door 250 is closed.

In the second and third embodiments illustrated in FIG. 6A and FIG. 7B, ices produced from the icemaker 400 are stored in the cavity 500. In this case, an outlet 520 is provided at the lower part of the cavity 500 for discharging ices stored in the cavity 500 to the dispenser 260.

Meanwhile, in the present invention, the ices are not necessarily stored in the cavity 500 and may be stored in the ice container 590 separately provided in the cavity 500. Examples describing the ice container 590 are provided in the cavity 500 are well illustrated in FIG. 6B and FIG. 7B. Referring to FIG. 6B and FIG. 7B, the ice container 590 has an opened top and an outlet 520*a* provided at the lower part of the cavity 500.

Although it is not illustrated, it is desirable that the cavity 500 is surrounded with the insulating material in the refrigerator according to the present invention in order that cool air supplied from the supplementary freezer 300 is prevented from being transmitted to the outside of the door 250 or to the cooling chamber 200.

Meanwhile, a shutter 530 is provided between the dispenser 260 and the cavity 500 in the refrigerator according to the present invention. The shutter 530 is provided to be able to selectively open the outlet 520 and 520*a*.

Meanwhile, an ice chute 255 is provided at the door 250 for connecting the outlet 520 and 520*a* with the dispenser 260 as illustrated in FIG. 6A and FIG. 7B.

When the structure is formed as this, ices produced from the icemaker 400 are stored in the cavity 500 or in the ice container 590 through the outlet 320 of the supplementary freezer 300 and the inlet 510 of the cavity 500. Ices stored in the cavity 500 or in the ice container 590 are supplied to the user through the dispenser 260 after being passed through the outlet 520 of the cavity 500 when the shutter 530 is opened.

Meanwhile, the refrigerator according to the second and third embodiments and the various embodiments of the embodiments of the present invention further includes a transferring device 540 for transferring ices stored in the cavity 500 or the ice container 590 to the outlet 520 and 520*a*. The transferring device 540 further includes an auger 541 and a motor 545 as illustrated in FIG. 6A and FIG. 8. The auger 541 includes a shaft 542 horizontally provided in the cavity 500 or the ice container 590, and a blade 543 projected in a spiral form along the longitudinal direction of the outer circumferential surface of the shaft 542. The auger 541 having such a structure transfers ices being stored in the cavity 500 or the ice container 590 to the outlet 520 and 520*a* in a vertical direction. The motor 545 coupled with the auger rotates the auger.

The refrigerator according to the second and third embodiments of the present invention provides a structure that the user is supplied with crushed ices through the dispenser 260. A crusher 550 is provided for crushing ices stored in the cavity 500 or the ice container 590.

The crusher 550 includes a shaft rotated by the motor and a blade for rotating together with the shaft and crushing ices. In this case, the motor and the shaft of the crusher 550 are separately provided from the motor 545 and the shaft 542 of the transferring device 540. However, FIG. 6A to FIG. 8 show an embodiment that the motor 545 and the shaft 542 are jointly shared by the transferring device 540 and the crusher 550.

Referring to FIG. 6A to FIG. 8, the blade 551 of the crusher 550 is extended from an end of the shaft 542 rotated by the motor 545 in a radial direction. At least one or more of the blade 551 is provided and rotates together with the shaft 542. When the transferring device 540 and the crusher 550 are provided to the refrigerator according to the second and third embodiments and the various embodiments, the crusher 550 is extended from an end of the transferring device to crush ices transferred by the transferring device 540.

The dispenser 260 is provided at the door 250 as illustrated in FIG. 6A to 7B. Accordingly, the user is supplied with ices stored in the cavity 500 and the ice container 590 without opening the door 250. At this time, the present invention provides a structure for supplying the user with either crushed ices or uncrushed ices through the dispenser 260. Hereinafter, it will be briefly described with reference to FIG. 6A to FIG. 8.

Referring to FIG. 6A to FIG. 8, the outlet 520 and 520*a* of the cavity 500 or the ice container 590 includes first outlets 521 and 521*a*, and second outlets 525 and 525*a*. The first outlets 521 and 521*a* are provided at a lower part of the crusher 550 and the second outlets 525 and 525*a* are provided near the crusher 550 at a lower part of the auger 541. It is desirable that the second outlets 525 and 525*a* are provided at a proper location in a proper size in order to prevent that ices transferred by the auger 541 are not easily slipped out before being crushed by the crusher 550. The shutter 530 is provided to selectively open the first outlets 521 and 521*a*.

When the shutter 530 closes the first outlets 521 and 521*a* in the refrigerator formed as aforementioned, ices are transferred by the transferring device 540, crushed by the crusher 530 and supplied to the dispenser 260 through the second outlets 525 and 525*a*. Accordingly, the user is supplied with the crushed ices. On the other hand, when the shutter 530 opens the first outlets 521 and 521*a*, ices are transferred to the transferring device 540 and supplied to the dispenser 260 through the opened first outlets 521 and 521*a* before being reached to the crusher 550.

Meanwhile, when the outlets 520 and 520*a* include only a hole, the user is selectively supplied with crushed ices or uncrushed ices through the dispenser 260. In other words, uncrushed ices are supplied through the dispenser 260 when the crusher 550 does not operate but only the transferring device 540 operates and crushed ices are supplied through the dispenser 260 when the crusher 550 and the transferring device 540 operate at the same time. In this case, the crusher 550 is controlled apart from the transferring device 540.

Also, when the outlets 520 and 520*a* include only a hole and the shutter 530 is able to control the opening and shutting of the outlets 520 and 520*a*, crushed or uncrushed ices are selectively supplied through the dispenser 260. These various structures will sufficiently be implemented with an above description.

Meanwhile, the refrigerator according to the second and third embodiments further includes a water tank (not shown) for supplying cold water to the dispenser 260 although it is not illustrated. The water tank is provided at the door to be communicated with the cooling chamber 200 as illustrated in FIG. 2. A control panel is provided at an outside of the door for the user to select cold water, crushed ices, or uncrushed ices through the dispenser 260. Then, the user operates the control panel to be selectively supplied with water ors ices through the dispenser 260.

Hereinafter, an operation of the refrigerator according to the second, third and various embodiments of the present invention will be briefly described. First, the icemaker 400 produces ices using cool air of the freezer 330. The produced ices are passed through the outlet 320 of the supplementary freezer 330 and the inlet 510 of the cavity 500, and stored in the cavity 500 or the ice container 590.

In this condition, when the user operates the control panel provided at the door 250 to get uncrushed ices, the motor 545 operates and the auger 541 rotates transferring the ices stored in the cavity 500 or the ice container 590 to the outlets 520 and 520*a* of the cavity 500 or the ice container 590. At this time, it is a state that the shutter 530 opened the first outlets 521 and 521*a* and thus, the transferred ices pass through the first outlets 521 and 521*a*, and the ice chute 255.

When the user operates the control panel provided at the door 250 to get crushed ices, the motor operates and the auger 541 rotates transferring ices stored in the cavity 500 or the ice container 590 to the outlets 520 and 520*a* of the cavity 500 or the ice container 590. At this time, it is a state that the shutter 530 closed the first outlets 521 and 521*a*, and thus, the transferred ices are crushed in the crusher 550. The crushed ices pass through the second outlets 525 and 525*a* and the ice chute 255, and supplied to the user through the dispenser 260.

Meanwhile, when the user operates the control panel provided at the door 250 to get cold water, cold water stored in the water tank is supplied to the user through the dispenser 260.

The refrigerator according to the present invention has following advantages.

First, the dispenser is provided at the door for supplying ices or water, and thus, the user is supplied with ices or water at the outside of the refrigerator without opening the door.

Second, the user is supplied with ices or water without opening the door, and unnecessary energy is prevented from being wasted.

Third, the cooling chamber is provided at the upper part of the refrigerator and the supplementary freezer is provided in the cooling chamber for cooling the icemaker in the present invention. Accordingly, the refrigerator includes the dispenser provided at a convenient location for the user to use.

Fourth, the crusher is provided in the refrigerator according to the present invention, and it is convenient for the user to selectively be supplied with uncrushed ices or crushed ices through the dispenser.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A refrigerator with an icemaker, comprising:

a supplementary freezer provided in a cooling chamber of the refrigerator, the supplementary freezer including an evaporator and a fan for providing cool air;

an icemaker for producing ices by using the cool air provided by the supplementary freezer;

a cavity being within a door of the refrigerator for storing the ices, the cavity being communicated with the supplementary freezer when the door is closed, the cool air being transmitted to the cavity by the fan when the door is closed; and a dispenser provided to be communicated with the cavity at the door.

2. The refrigerator with the icemaker of claim 1, wherein the icemaker is provided in the supplementary freezer.

3. The refrigerator with the icemaker of claim 1, wherein the icemaker is provided at the cavity.

4. The refrigerator claim 1, wherein the supplementary freezer provided at an upper part in the cooling chamber comprises:

a housing being communicated with the cavity when the door is closed; and said evaporator provided in the housing.

5. The refrigerator with the icemaker of claim 1, wherein the cavity is surrounded with an insulating material.

6. The refrigerator with the icemaker of claim 1, further comprising a shutter provided between the cavity and the dispenser for selectively supplying the dispenser with the ices.

7. The refrigerator with the icemaker of claim 1, further comprising an ice container provided at the cavity for storing ices produced by the icemaker.

8. The refrigerator with the icemaker of claim 7, wherein the ice container comprises:

an opened top for receiving the ices produced and dropped from the icemaker; and an outlet provided at the lower part for discharging the ices to the dispenser.

9. The refrigerator with the icemaker of claim 1, further comprising a transferring device provided in the door for transferring the ices stored in the cavity to an outlet communicated with the dispenser.

10. The refrigerator with the icemaker of claim 7 further comprises a transferring device provided at the ice container for transferring the ices stored in the ice container to the outlet being communicated with the dispenser.

11. The refrigerator with the icemaker of claim 1, further comprising a crusher provided at the cavity for crushing the ices stored in the cavity.

12. The refrigerator with the icemaker of claim 11, wherein the crusher comprises:

a horizontal shaft rotatable by a motor, and at least one blade extended from the horizontal shaft in a radial direction and rotating together with the shaft for crushing the ices.

13. The refrigerator with the icemaker of claim 7, further comprising a crusher provided at the ice container for crushing the ices stored in the ice container.

14. The refrigerator with the icemaker of claim 13, wherein the crusher comprises:

a horizontal shaft rotatable by a motor, and at least one blade extended from the horizontal shaft in a radial direction and rotating together with the horizontal shaft for crushing the ices.

15. The refrigerator with the icemaker of claim 9, wherein the transferring device has a horizontal shaft.

16. The refrigerator with the icemaker of claim 15, wherein the ices are crushable by the transferring device, the transferring device selectively permitting disposition of the ices stored in the cavity and crushed ices by crushing the ices stored in the cavity to the outlet communicated with the dispenser.

17. The refrigerator with the icemaker of claim 16, wherein the transferring device comprises:

an auger rotatable along the horizontal shaft, the auger being disposed at the cavity for transferring the ices to the outlet without crushing the ices;

a crusher rotatable along the horizontal shaft, the crusher being disposed at the cavity for crushing the ices stored in the cavity; and a motor disposed in the door for rotating the horizontal shaft.

18. The refrigerator with the icemaker of claim 10, wherein the transferring device has a horizontal shaft.

19. The refrigerator with the icemaker of claim 18, wherein the ices are crushable by the transferring device, the transferring device selectively permitting disposition of the ices stored in the cavity and crushed ices by crushing the ices stored in the cavity to the outlet communicated with the dispenser.

20. The refrigerator with the icemaker of claim 19, wherein the transferring device comprises:

an auger rotatable alone the horizontal shaft, the auger being disposed at the cavity for transferring the ices to the outlet without crushing the ices;

a crusher rotatable along the horizontal shaft, the crusher being disposed at the cavity for crushing the ices stored in the cavity; and a motor disposed in the door for rotating the horizontal shaft.

21. The refrigerator with the icemaker of claim 1, further comprising a freezer at a bottom portion of refrigerator, the supplementary freezer and the cooling chamber being at a top portion of the refrigerator.

* * * * *